US006508025B1

(12) United States Patent
Du Plessis

(10) Patent No.: US 6,508,025 B1
(45) Date of Patent: Jan. 21, 2003

(54) BOLT ACTION FOR RIFLES

(75) Inventor: Alexander Benjamin Du Plessis, Gauteng (ZA)

(73) Assignee: Truvelo Manufacturers (Pty) Ltd, Gauteng (ZA)

( * ) Notice: Subject to any disclaimer, the term of this patent is extended or adjusted under 35 U.S.C. 154(b) by 59 days.

(21) Appl. No.: 09/708,705

(22) Filed: Nov. 9, 2000

(30) Foreign Application Priority Data

Nov. 10, 1999 (ZA) ..... 99/7024

(51) Int. Cl.[7] ..... F41A 3/00
(52) U.S. Cl. ..... 42/16; 42/69.02
(58) Field of Search ..... 42/16, 2, 69.02, 42/90

(56) References Cited

U.S. PATENT DOCUMENTS 1,545,045 A * 7/1925 Dute ..... 42/16
3,341,963 A * 9/1967 Seiderman ..... 42/16
4,020,577 A * 5/1977 Duffy ..... 42/16

FOREIGN PATENT DOCUMENTS

GB 778083 7/1957

* cited by examiner

*Primary Examiner*—J. Woodrow Eldred
(74) *Attorney, Agent, or Firm*—Jacobson Holman, PLLC

(57) ABSTRACT

A bolt action for a firearm which comprises a bolt with a removable handle which can be attached to the bolt for left handed use or for right handed use. The receiver has slots for back and forth movement and rotation to left or to right to close the chamber and has apertures for safe cartridge ejection either to the left or to the right according to the position of the handle. Primary cartridge extraction is provided for both in left handed and right handed use by a cam surface of equilateral triangular shape on the receiver and a co-acting shape on a neck of the handle as well as protection against erroneous movement of the handle to the wrong side, in use.

13 Claims, 3 Drawing Sheets

BOLT ACTION FOR RIFLES

FIELD OF THE INVENTION

This invention lies in the field of bolt action firearms. In particular the invention relates to the bolt action of rifles as epitomised, for example, by the Mauser bolt action. The bolt action consists of a bolt moving back and forth in a receiver and held in the position in which it shuts the chamber by locking its handle or lugs against an abutment in the receiver with a quarter turn of the bolt.

BACKGROUND OF THE INVENTION

The Inventor is aware that presently most bolt action rifles are made for right handed users, i.e. the right hand is used for operating the bolt, the face and body are to the left of the rifle and spent cartridges are ejected to the right There are, however, some bolt action rifles made exclusively for left handed users, i.e. the left hand is used for operating the bolt, the face and body are to the right and spent cartridges are ejected to the left.

It is a recognised problem in the art that when a left handed user uses a right hand bolt operation rifle (or less commonly a right handed user uses a left hand bolt operation rifle), the use is awkward and there is a risk of injury to the user. This is due to a tendency for the user to place the face and body on the side to which spent cartridges are ejected from the rifle.

A large number of existing bolt action rifles are based on the Mauser K98 action which consists of a bolt with a handle which is an integral part of the bolt, on the right hand side to be operated normally with the right hand and a receiver within which the bolt is axially displaceable. With the bolt in the firing position, the bolt handle is down to the right of the action and two or more lugs on the bolt locate into recesses inside the receiver holding the chamber closed with the cartridge inside.

To eject a spent cartridge and load a new round the bolt handle is lifted upwards rotating the bolt anti-clockwise through 90 degrees. During this rotation a part of the bolt or bolt handle engages an angled surface or cam surface on the receiver forcing the bolt rearwards. This is known as the primary extraction which is very important as the leverage obtained against the cam surface is designed to release cartridge cases that may get stuck after firing due to dirt or over pressure etc. Once the bolt reaches the full 90 degree travel the lugs inside the receiver are freed from the recesses and located in slots which allow the bolt to be pulled to the rear of the action. The rearward movement of the bolt brings with it the cartridge case the rim of which is gripped by the extractor at the front of the bolt. As the bolt approaches its complete rearward travel the cartridge case is ejected out of the right hand side of the action by means of an ejector which is a sprung component either set in the head of the bolt or in the side of the action.

Generally when a left handed rifle is required the whole action and bolt has to be built the opposite way around or mirror reversed, allowing the left handed person to be able to operate the weapon with his left hand rotating the bolt clockwise to open the bolt.

Such left handed bolt actions are few and far between and tend to be extremely expensive as not many manufacturers make them and those that do in small quantities. More often than not when a left handed person requires a rifle he is obliged to settle for a normal right handed action fitted with a left handed stock.

SUMMARY OF THE INVENTION

A solution of these problems according to the invention is to provide a bolt action for a firearm which is configured to be interchangeably useable by left handed and right handed users.

The bolt action includes a receiver, a bolt axially displaceable within the receiver, a bolt handle for the bolt, formations for locking the bolt in a position in which it doses the chamber of the firearm, extractor and elector means in the action, a firing pin in the bolt, characterised in that the receiver and/or bolt have/has cam surfaces oriented for primary extraction both by clockwise and anti-clockwise rotation of the bolt, the receiver has apertures for spent cartridge ejection to both left and right hand sides of the firearm and the handle is oriented relative to the bolt for configuration either to the left hand or right hand of the bolt.

The bore of the receiver may include a guide slot or slots and the bolt a co-acting lugs or lugs. The guide slot(s) extend(s) longitudinally along the bore of the receiver for movement of the bolt back and forth and circumferentially both clockwise and anti-clockwise in the bore for locking the action by e.g. a quarter turn. If there are two slots they must be in two angularly separated positions, similarly if there are two lugs. There may be both two slots and two lugs. There may be two (or more) axially separated sets of lug(s) and slot(s), to provide better assurance against failure of the lug(s) due to overpressure, etc.

The receiver may have a circumferential slot for a co-acting lug or lugs on the bolt handle or a co-acting neck of the handle located adjacent the bolt in use.

These arrangements permit the bolt handle to be oriented relative to the bolt so that the bolt can be used to rotate the bolt to the left or to the right, as desired, for left hand or right hand axial displacement of the bolt.

The bolt handle may be oriented relative to the bolt by being removable from the bolt for reattachment in the desired left hand or right hand configuration. This reattachment may be by insertion into the same hole in the bolt with the handle rotated either to left or to right i.e. by one hundred and eighty degrees. In a preferred embodiment there are two holes in the bolt for insertion of the handle into one for right hand use and into the other for left hand use. These two holes in the bolt may be one hundred and eighty degrees angularly separated from each other. The holes may be given a non-symmetrical shape to ensure that the handle is correctly inserted in each case. Other formations than holes may be provided for attaching the handle to the bolt.

An alternative arrangement may be for the handle to remain attached to the bolt but be rotated in its attachment to a position for left hand use or to a position for right hand use.

The cam surfaces may be provided either on the receiver, in the slots in the bore of the receiver, on the bolt, on the lugs on the bolt or on the handle, with a follower on a co-acting part, or a cam surface on both co-acting parts. In a preferred embodiment the cam surfaces are provided on the receiver, positioned to act against the handle when it is attached to the bolt in either the left hand or right hand configuration. Preferably the handle has cam surfaces that act as followers of or co-act with the cam surfaces of the receiver.

The cam surfaces on the receiver may be in the form a triangular projection having an apex directed towards the rear. The triangular projection may be in the form of an equilateral triangle.

The cam surfaces may include one or more arcuate zone, for example, in the form of a pair of parabolic or hyperbolic curves meeting at an apex directed towards the rear.

The bolt handle may include a neck adjacent the bolt provided with a cam following surface. This surface may be configured complimentarily to the cam surface.

The guide slot(s) and/or lugs and/or the handle preferably have a stop member provided in a central zone of said slot(s) and/or lug(s) or other means adapted to reduce the risk of the bolt handle being rotated between the left hand and right hand configurations when this is not desired. Such undesired rotation can result in jamming or other adverse or dangerous consequence.

In one embodiment, the cam following surface of the neck of the handle is a polygon having a corner directed towards and offset from the apex of the cam surface, to reduce the risk of the bolt handle crossing over between the left hand and right hand configuration when this is not desired.

The stop member may be in the form of a cam surface or surfaces, e.g a cam surface on the receiver directed towards the rear such that when the bolt handle or a formation on the bolt engages It the bolt is rotationally displaced as it moves towards the rear, primary extraction of a cartridge in the receiver takes place and over-turning of the bolt is inhibited.

The receiver may include a pair of opposed laterally directed apertures for ejection of a cartridge from the receiver either to the right or to the left of a user, as desired, for left hand or right hand use of the bolt, respectively.

The bolt is preferably provided with cartridge extractor and ejector means at the opposite end of the bolt from the bolt handle, the extractor means being displaceable in sympathy with the bolt in conventional manner.

The receiver may include a channel in which a flange of a firing pin is located and which inhibits the firing pin from rotating as the flange is trapped within this channel. The bolt may have at its rear a chamfer which when the bolt is rotated to free it from the position in which it closes the chamber, after a shot, the rotation causes the firing pin flange to ride up this chamfer effectively pulling the firing pin rearward to cock it. This chamfer is symmetrical so that whether the bolt is rotated clockwise or anti-clockwise the firing pin will ride up this chamfer to cock the firing pin, thereby providing for left hand or right hand configuration. The sear of the firing mechanism is also located in the channel so that when the bolt is returned to close the chamber with a new round in it for the next shot, the firing pin flange engages the sear, to retain the firing pin in the cocked condition, to be released when the trigger is pulled.

The chamfer may be in the form of two chamfered portions extending from a common source, mirror-image fashion.

According to a second aspect of the invention, there is provided a receiver for a bolt action weapon, the receiver including a circumferential guide slot in the bore of the receiver for lugs on the bolt and/or for a bolt handle, which guide slot extends along a portion of the circumference of the receiver both to the left and to the right of a plane intersecting the longitudinal axis of the receiver, thereby permitting the bolt handle to be displaced along the guide slot to rotate the bolt to the left and to the right, as desired, for left hand or right hand axial displacement of the bolt.

The guide slot may have a bolt handle stop member provided in a central zone of said slot, thereby reducing the risk of the bolt handle crossing over between the left hand and right hand configuration when this is not desired.

The stop member may be in the form of a cam surface directed towards the rear of the receiver such that when the bolt handle engages and is displaced along the cam surface, primary extraction of a cartridge in the receiver takes place.

The cam surface may be in the form a triangular projection having a apex directed towards the rear. The triangular projection may be in the form of any acute angled triangle, typically an equilateral or a right angled triangle.

The cam surface may include one or more arcuate zone(s), for example, in the form of a pair of parabolic or hyperbolic curves meeting at an apex directed towards the rear.

The receiver may include a pair of opposed laterally directed apertures for ejection of a cartridge from the receiver either to the left or to the right of a user away from the user, as desired.

According to a third aspect of the invention there is provided a bolt for a bolt action weapon, the bolt including a bolt handle which is displaceable relative to the bolt for configuration of the weapon to permit either left hand or right hand axial displacement of the bolt.

The bolt handle may be removable from the bolt for reattachment in the desired left hand or right hand configuration.

The bolt handle may include a neck portion directed towards the bolt and being provided with a cam engaging surface.

The cam engaging surface may be configured complimentary to a cam surface of the weapon.

In one embodiment, the cam engaging surface of the neck portion is a polygon having a corner directed towards and offset from the apex of the cam surface, thereby reducing the risk of the bolt handle crossing over between the left hand and right hand configuration when this is not desired.

The bolt is configured such that when the bolt is displaced and rotated to the right, a cartridge is ejected to the right away from the user, and vice versa.

The bolt may be provided with a cartridge extractor portion at the bolt handle remote end of the bolt, the extractor being displaceable in sympathy with the bolt.

According to a further aspect of the invention there is provided a bolt action firearm convertible, e.g. in the field, from left handed configuration to tight handed configuration, said weapon including at least one of the action, the receiver, and the bolt, substantially as described above.

DESCRIPTION OF THE DRAWINGS

The invention will now be described, by way of non-limiting example only, with reference to the accompanying drawings.

In the drawings.

DESCRIPTION OF THE PREFERRED EMBODIMENTS

Figure 1:
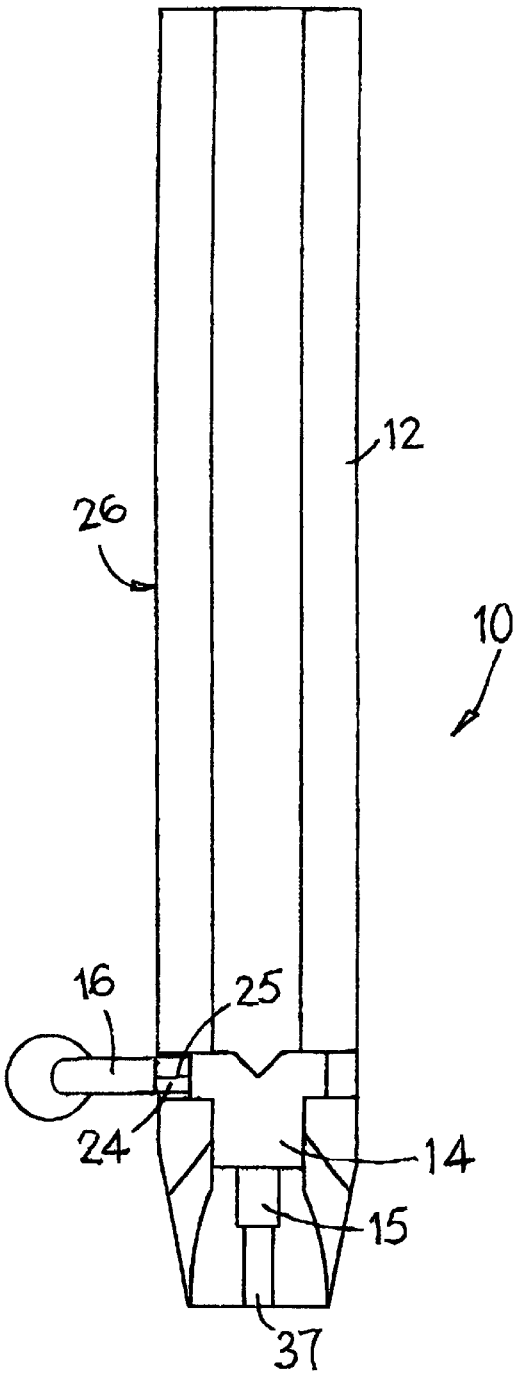
FIG. 1 shows, in plan view, the action in accordance with the invention in a left hand user configuration.

In the Figures, reference numeral 10 generally indicates a bolt action for a firearm in accordance with a preferred embodiment of this invention.

The action 10 is similar to the normal two lug bolt action design, like the Mauser K98. The action 10 includes a receiver 12, a bolt 14 axially displaceable within the receiver, a bolt handle 16 for the bolt, formations for locking the bolt in a position in which it closes the chamber of the firearm comprising lugs pairs 11 and 13 on the bolt and circumferential grooves 31 and 33 in the bore of the receiver. Longitudinal grooves 34 and 35 in the bore of the receiver allow the bolt to be axially displaced within the receiver. Extractor means 17 and ejector means 18 are on the end 20 of the bolt and a firing pin 15 is located in the bolt. The action differs in that the receiver has a cam surface 22 for primary extraction both by clockwise and anti-clockwise rotation of the bolt. The cam surface is a symmetrical having a triangular shape and an apex 23. The receiver of the action has two apertures for ejection of spent cartridges on the left 19 and on the right 21. The bolt and the bolt handle are separate components, and the handle can be removed from one side of the bolt 14 and placed in the bolt 14 from the opposite side (see FIGS. 1 and 2). The handle has a forked part 28 which can be inserted either into a hole 32 in the bolt from the left or in a hole 33 in the bolt from the right. The holes 32 and 33 are separated by an angle of one hundred and eighty degrees on the bolt. Both holes are asymmetrical so that in both cases the handle can only be put in the correct way. In this example, the firing pin assembly must be pulled out of the bolt to insert or remove the handle and when the pin assembly is inserted it engages formations 33 and holds the handle so that it can not be removed from the bolt.

Figure 2:
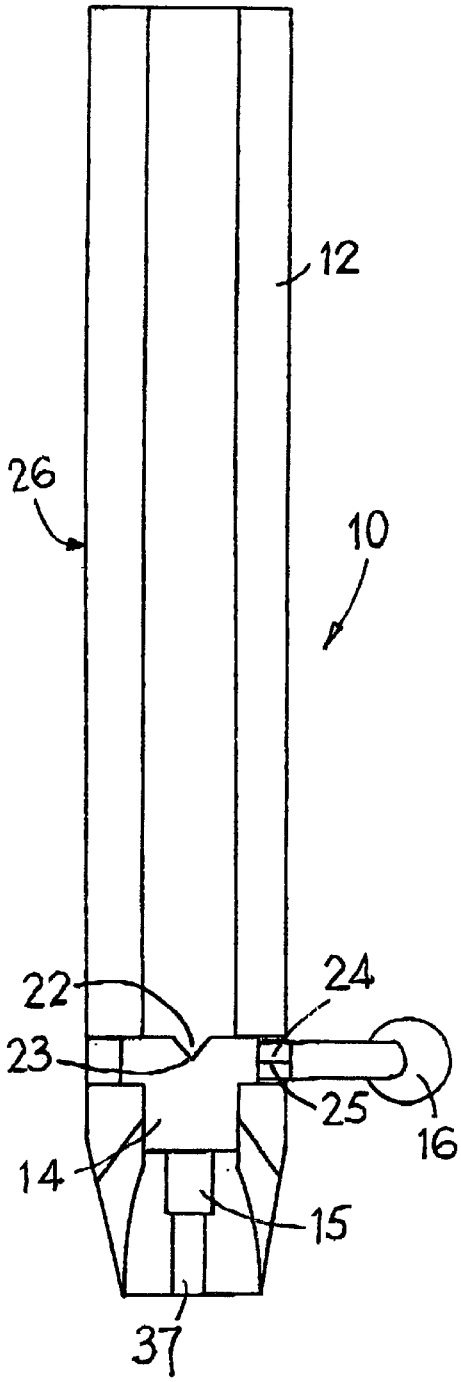
FIG. 2 shows, in plan view, the action shown in FIG. 1 in a right hand user configuration.
Figure 3:
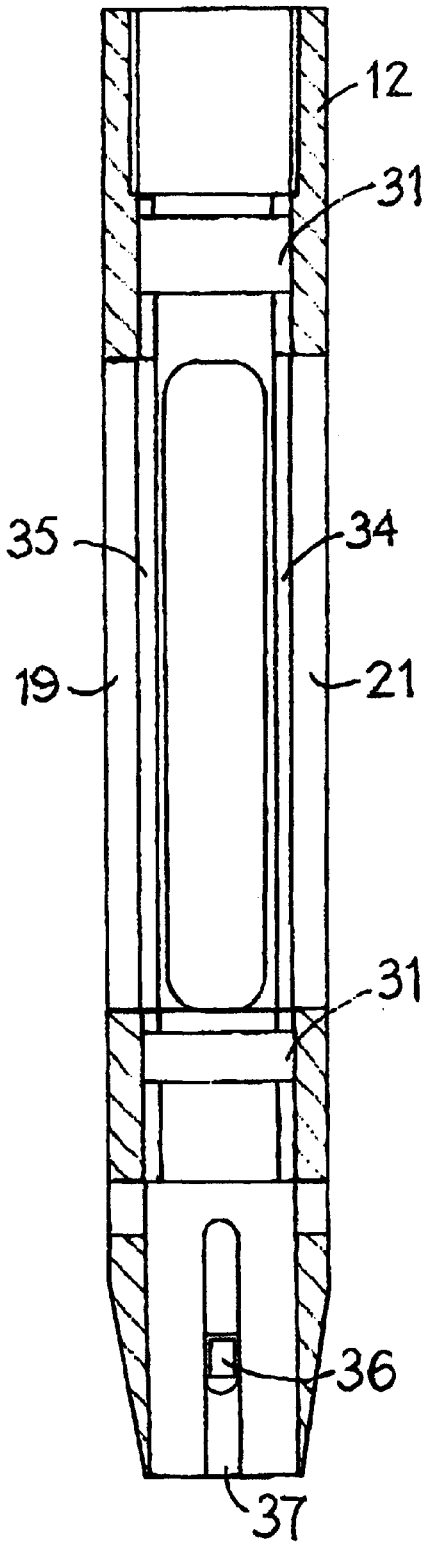
FIG. 3 shows, in plan view on a section X—X (see FIG. 4), the receiver of the action shown in FIG. 1.
Figure 4:
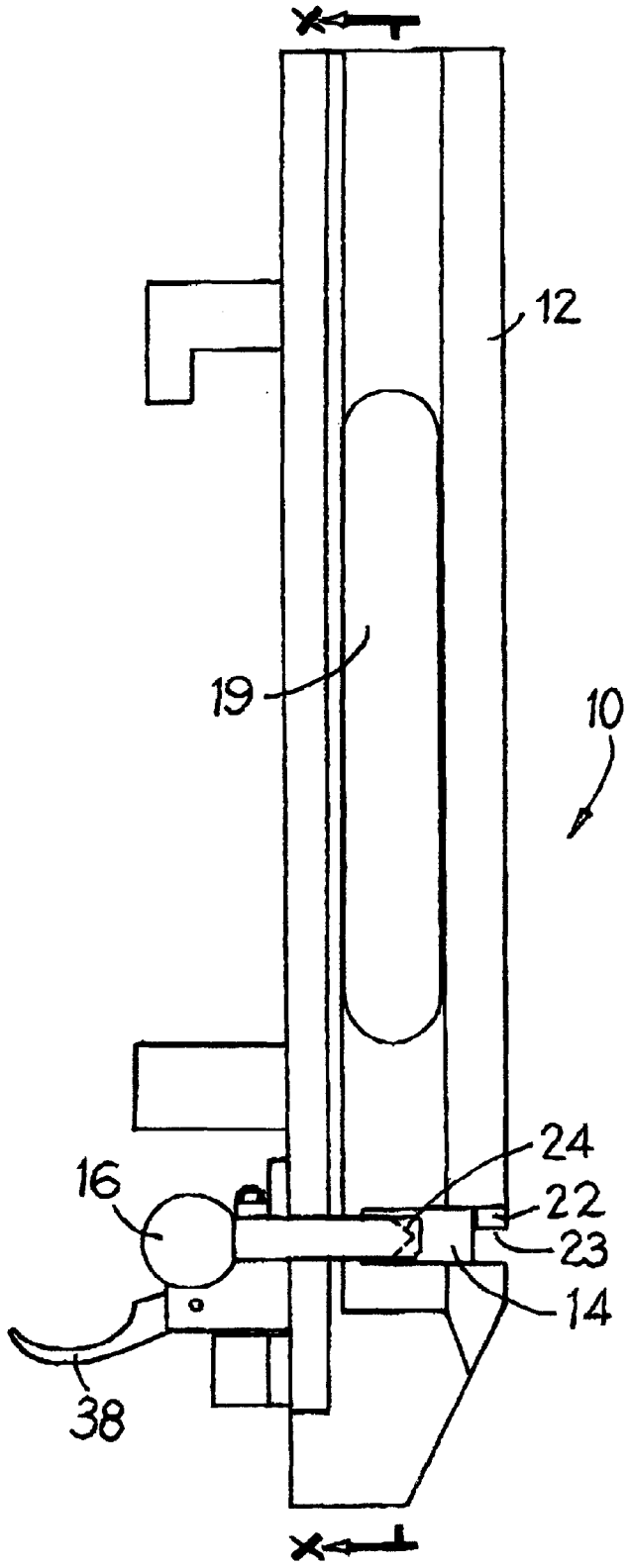
FIG. 4 shows, in a side view from the left, the action shown in FIG. 1.
Figure 5A:
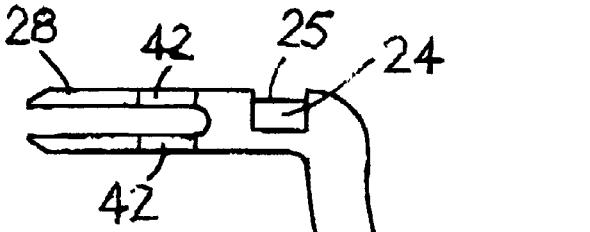
(FIG. 5A shows the handle which fits the bolt)
Figure 6A:
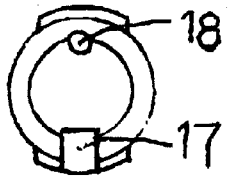
FIG. 6 shows, in underneath view, the bolt of the action shown in FIG. 1 (with an end view 6A).
Figure 5:
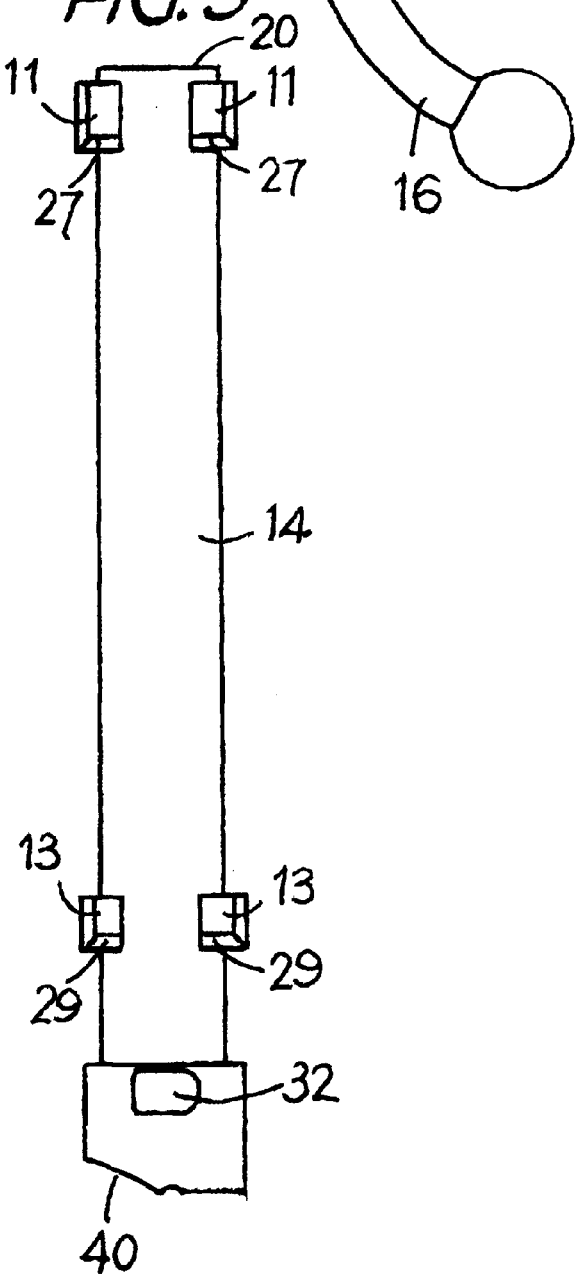
FIG. 5 shows, in a side view from the left, the bolt of the action shown in FIG. 1.
Figure 6:
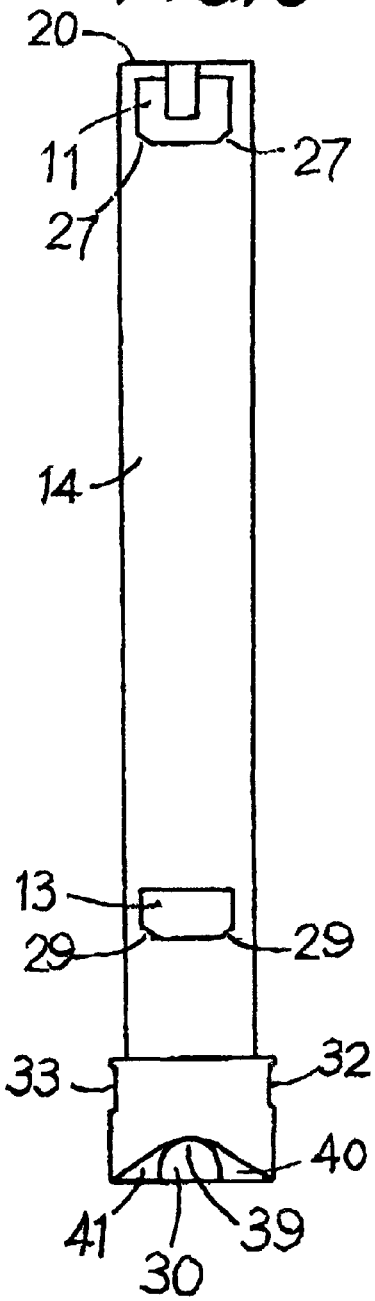

The firing pin assembly (the rear end 15 is seen in FIGS. 1 and 2) operates through the center of the bolt. The bolt has an extractor 17 and ejector 18 at the bolt head 20 (see FIGS. 6 and 6A).

The bolt with the bolt handle on the left hand side (FIG. 1) and on the right right hand side (FIG. 2) work the same way except that the former requires the handle and bolt to be rotated clockwise a quarter turn to unlock it from the left handed position shown in FIG. 1 and rotated anti-clockwise a quarter turn to unlock it from the right handed position shown in FIG. 2. The neck of the handle has a cam or follower surface 24 with an apex 25. In both cases when the cam surface of the handle engages the cam surface of the receiver primary extraction of the cartridge occurs before the rotation of the bolt reaches the full 90 degrees. Chamfers 27 and 29 on the lug pairs 11 and 13 permit this cam action. On reaching the full 90 degrees the user pulls the bolt to the rear, the lugs sliding in the longitudinal grooves in the receiver bore, and this will eject a cartridge case (not shown) when it approaches the end of its travel. The cartridge case will eject to the left in FIG. 1 (left handed use) and to the right in FIG. 2 (right handed use).

If the bolt 14 is now pushed forward to put a new cartridge in the chamber the cam surface of the neck of the handle passes the apex of the cam surface on the receiver before the bolt 14 is able to turn. (The lugs on the bolt are still in the longitudinal grooves inside the receiver). The cam surface on the handle then makes contact with the same side of the triangular shape of the cam surfaces on the receiver as the handle, which forces the bolt clockwise if the handle is to the right or anti-clockwise if the handle is to the left. At this stage the lugs on the bolt have reached the circumferential cavities inside the receiver 12. By further movement the bolt handle 16 is forced downwards and when it reaches the end of the rotation to the full 90 degrees the lugs are locked inside the circumferential grooves in the bore of the receiver.

When the bolt is in the closed position the extractor and ejector in the head of the bolt are on a vertical axis, with handle on the right the extractor is at the bottom and with the handle at the left the extractor is at the top.

Therefore with the handle on the right hand, when the bolt is rotated 90 degrees anti-clockwise to unlock the bolt, the extractor 18 is also rotated through 90 degrees anti-clockwise in sympathy with the bolt and will be located on the right hand side of the bolt and ejector on the left which ejects the cartridge case out the right hand side of the action.

With the handle on the left side the bolt is rotated clockwise and the cartridge is ejected to the left.

The firing pin has a flange which runs in a groove 37 in the bore of the receiver which keeps the pin from rotating but allows it to be moved back to cock the pin and move forward to fire a round. The flange is engaged by the sear 36 of the release mechanism of the trigger 38 when cocked. When the bolt is in the position closing the chamber (either left-handed or right-handed) there is a recess 39 at the rear of the bolt which clears space for the flange on the firing pin which allows the firing pin to reach the cartridge when the firing pin is released by the trigger mechanism.

On both sides of the recess 39 in the rear of the bolt there are chamfers 40 and 41 which when the bolt is rotated clockwise or anti-clockwise causes the firing pin to ride up one or the other of these chamfers pulling the firing pin rearward away from the sear. This disables the firing pin ensuring that it can not accidentally discharge a round.

The angled section on the triangular cam surface 22 and the angled section 24 on the bolt handle ensure that the bolt can only be rotated clockwise to close and lock, when in a right hand user configuration, or anti-clockwise in a left hand user configuration.

When the bolt handle is removed and placed into the same aperture on the opposite side for left handed operation, it would mean that the bolt is in fact rotated 180 degrees before it can be inserted into the bolt. When the bolt is inserted into the receiver and pushed closed the angle on the opposite side of the bolt handle will pass the apex 25 and will make contact with the left hand side of the triangular cam surface on the receiver, thereby ensuring that the bolt can only be rotated anti-clockwise to lock.

As the bolt has been rotated 180 degrees the extractor is now sitting on the left hand side and will therefore eject the cartridge case on the left side when drawn to the rear. However, when pushing the bolt forward and closing it the bolt now rotates 90 degrees anti-clockwise therefore turning the extractor to the bottom position the same as when the handle was on the opposite side of the bolt. Also the recess at the rear of the bolt which allows the firing pin to travel forward to fire the weapon is once again in the right position. As this bolt is now rotated the opposite way to open it has also been machined with the chamfer on the right of this gap on the bolt which will force the firing pin sear to ride up the chamfer when rotating and so pulling the firing pin away from the front of the bolt.

This invention therefore allows one to change the rifle from being right handed to left handed simply by removing the bolt handle from the right hand side of the bolt and fitting it into the left hand side of the bolt.

The bolt handle interlocks with the firing pin assembly holding it in place and the firing pin spring forces a sleeve around the firing pin into a recess 42 in the bolt handle to hold it in place and to prevent it from coming out of the bolt body.

To remove the bolt handle the firing pin sleeve which sticks out at the rear of the bolt has to be depressed a small amount and the bolt handle can then easily be removed and put into the same aperture from the opposite side where when fully in position it will again be held in place by the firing pin sleeve and spring.

List of numerals used in drawings:

10 bolt action
11 lug pairs on bolt
12 receiver
13 lug pairs on bolt
14 bolt
15 firing pin rear end
16 bolt handle
17 extractor
18 ejector
19 left aperture
20 bolt head
21 right aperture
22 cam surface on receiver
23 apex of cam surface on receiver
24 cam surface on bolt handle
25 apex of cam surface on handle
26 central zone of receiver
27 chamfers on lugs
28 forked part of handle
29 chamfers on lugs
30 hole in bolt for firing pin
31 circumferential slots in bore of receiver
32 left hand hole in bolt for handle
33 right hand hole in the bolt for handle
34 longitudinal slot in receiver bore
35 longitudinal slot in receiver bore
36 sear
37 groove for firing pin flange
38 trigger
39 recess at rear of bolt
40 chamfer to left of recess at bolt rear
41 chamfer to right of recess at bolt rear
42 locking formation in forked part of handle

What is claimed is:

1. A firearm which has a receiver, a bolt axially displaceable within the receiver, a bolt handle for the bolt, the handle being adapted to be oriented relative to the bolt for either left hand or right hand configuration, a chamber, formations for locking the bolt in a position in which it closes the chamber, extractor and ejector means, and a firing pin in the bolt, and wherein:

a member selected from the group consisting of the receiver, the bolt and the bolt handle has cam surfaces oriented for primary extraction either by clockwise or counterclockwise rotation of the bolt;

the receiver has two apertures, one on the left-hand side and the other on the right-hand side, and a bore;

the bolt has a bolt head in which there is an extractor and an ejector, the extractor being at the bottom in firing position, for spent cartridge ejection to either left or right side of the firearm.

2. A firearm as claimed in claim 1, in which the receiver has a guide slot, and the bolt has a coacting lug, which lug extends longitudinally along the bore of the receiver for movement of the bolt back and forth and circumferentially, both clockwise and counterclockwise, in the bore for locking action by rotating the bolt to the left or to the right for left hand or right hand axial displacement of the bolt.

3. A firearm as claimed in claim 1, which has a firing pin assembly and in which the bolt handle is optionally oriented relative to the bolt by being removable from the bolt for reattachment in left hand or right hand configuration by insertion into a hole in the bolt with the handle rotated either to left or to right, or in two holes in the bolt rotated around the bolt, in either case by one hundred eighty degrees, in which the bolt handle interlocks with the firing pin assembly.

4. A firearm as claimed in claim 1, in which the cam surfaces are on the receiver and comprise a triangular shape with its apex facing the rear of the receiver.

5. A firearm as claimed in claim 1, in which the cam surfaces are on the neck of the bolt handle.

6. A firearm as claimed in claim 1, in which the receiver includes a channel in which a flange of the firing pin is located, the flange inhibiting the firing pin from rotating but allowing it to move axially, the bolt having at its rear a chamfer which is symmetrical and against which the flange bears so that, whether the bolt is rotated clockwise or counterclockwise from a firing position, the firing pin rides up the chamfer, moving to the rear to cock the firing pin, thereby providing for left hand or right hand configuration.

7. A firearm as claimed in claim 6, wherein the channel comprises a sear, so that the flange engages the sear to retain the firing pin in cocked position when the firing pin moves to the rear.

8. A firearm as claimed in claim 1, wherein the receiver has a bore and a circumferential guide slot in the bore for lugs on the bolt or for a bolt handle, which guide slot extends along a portion of the circumference of the receiver both to the left and to the right of a longitudinal slot in the bore of the receiver, thereby permitting the bolt handle to be rotated clockwise or counterclockwise, for left hand or right hand axial displacement of the bolt, and which includes a pair of opposed laterally directed apertures for ejection of spent cartridges either to left or to right.

9. A receiver for a bolt action weapon a claimed in claim 8, in which the guide slot for the handle has a bolt handle stop member provided in a central zone of said slot, thereby reducing the risk of the bolt handle crossing over between the left hand and right hand configuration when this is not desired.

10. A receiver for a bolt action weapon a claimed in claim 9, in which the stop member is in the form of a cam surface directed towards the rear of the receiver such that when the bolt handle engages and is displaced along the cam surface, primary extraction of a cartridge in the receiver takes place.

11. A firearm as claimed in claim 1 in which the bolt handle is displaceable relative to the bolt for configuration of the firearm to permit either left hand or right hand axial displacement of the bolt, in which the bolt handle is removable from the bolt for reattachment to it for configuration from one handedness to the other, and wherein the handle includes a neck portion directed towards the bolt and is provided with a cam engaging surface.

12. A firearm as claimed in claim 11, in which the cam surfaces on the neck portion form a polygon having a corner directed towards and offset from the apex of the cam surfaces, thereby reducing the risk of the bolt handle crossing over between the left hand and right hand configuration when this is not desired.

13. A firearm as claimed in claim 3, in which the cam surfaces are on the receiver and comprise a triangular shape with its apex facing the rear of the receiver.

* * * * *